US011801953B2

(12) United States Patent
Bison

(10) Patent No.: US 11,801,953 B2
(45) **Date of Patent: *Oct. 31, 2023**

(54) PALLET WRAPPING SYSTEM WITH OVERLAPPING BANDS

(71) Applicant: Darrel Bison, Phoenix, AZ (US)

(72) Inventor: Darrel Bison, Phoenix, AZ (US)

( * ) Notice: Subject to any disclaimer, the term of this patent is extended or adjusted under 35 U.S.C. 154(b) by 112 days.

This patent is subject to a terminal disclaimer.

(21) Appl. No.: 17/570,258

(22) Filed: Jan. 6, 2022

(65) Prior Publication Data

US 2023/0211908 A1 Jul. 6, 2023

(51) Int. Cl.

| | |
|---|---|
| ***B65B 11/58*** | (2006.01) |
| ***B65B 11/04*** | (2006.01) |
| *B65B 11/00* | (2006.01) |

(52) U.S. Cl.

CPC ..... *B65B 11/585* (2013.01); *B65B 11/04* (2013.01); *B65B 2011/002* (2013.01)

(58) Field of Classification Search

CPC ... B65B 11/006; B65B 11/045; B65B 11/585; B65B 11/025; B65B 2011/002

See application file for complete search history.

(56) References Cited

U.S. PATENT DOCUMENTS

| | | | |
|---|---|---|---|
| 1,109,461 | A | 9/1914 | Price |
| 1,351,809 | A | 9/1920 | Sutherland |
| 2,026,282 | A | 12/1935 | Leguillon |
| 2,823,530 | A | 2/1958 | Rikard |
| 3,019,573 | A | 2/1962 | Navikas |
| 3,793,798 | A | 2/1974 | Lancaster |
| 3,896,604 | A | 7/1975 | Marantz |
| 4,102,513 | A | 7/1978 | Guard |
| 4,166,589 | A | 9/1979 | Hoover |

(Continued)

FOREIGN PATENT DOCUMENTS

| | | |
|---|---|---|
| DE | 3933952 C1 | 5/1990 |
| DE | 19505240 | 3/1996 |

(Continued)

OTHER PUBLICATIONS

JPO machine translation of JP 10-129609 A, Aug. 14, 2013 4 pages.

(Continued)

*Primary Examiner* — Andrew M Tecco

(74) *Attorney, Agent, or Firm* — BOOTH UDALL FULLER, PLC; Kenneth C. Booth

(57) ABSTRACT

A method of wrapping a palletized load includes forming at least two composite stretch films, wrapping each of the composite stretch films around the palletized load, and leaving a gap between the first composite stretch film and the second composite stretch film as the composite stretch films are wrapped around the palletized load. Forming the composite stretch films includes narrowing stretch film from a first spool to create a first banded stretch film with a first width, narrowing stretch film from a second spool to create a second banded stretch film with a second width smaller than the first width, and overlaying the second banded stretch film on the first banded stretch film, with the second banded stretch film positioned between the top edge and bottom edges of the first banded stretch film. The gap may have a width that is equal to or larger than the first width.

20 Claims, 5 Drawing Sheets

(56) References Cited

U.S. PATENT DOCUMENTS 4,172,608 A 10/1979 Brown, Jr.
4,235,062 A 11/1980 Lancaster, III
4,255,918 A 3/1981 Lancaster
4,353,515 A 10/1982 Weaver
4,369,614 A 1/1983 Tetzner
4,409,776 A 10/1983 Usui
4,468,922 A 9/1984 McCrady
4,530,473 A 7/1985 Parry
4,619,102 A 10/1986 Geisinger
4,671,043 A 6/1987 Forni
4,723,393 A 2/1988 Silbernagel
4,739,945 A 4/1988 Yokoe
4,754,594 A 7/1988 Lancaster
4,807,427 A 2/1989 Casteel
4,827,700 A 5/1989 Rampe
4,845,920 A 7/1989 Lancaster
4,905,448 A 3/1990 Plitt
4,905,451 A * 3/1990 Jaconelli ..... B65B 61/00 53/410
4,961,306 A 10/1990 Sawhney
5,031,771 A 7/1991 Lancaster
5,079,898 A 1/1992 Springs
5,107,657 A 4/1992 Diehl
5,125,209 A 6/1992 Thimon
5,168,685 A 12/1992 Suzuki
5,195,297 A 3/1993 Lancaster
5,203,939 A 4/1993 Sperling
5,211,353 A 5/1993 Lewin
5,307,609 A 5/1994 Kurata
5,315,808 A 5/1994 MacIvor
5,358,594 A 10/1994 Darrieux
5,385,001 A 1/1995 Ramer
5,409,177 A 4/1995 Parry
5,447,009 A 9/1995 Oleksy
5,535,962 A 7/1996 Bargowski
5,561,971 A 10/1996 Sampson
5,653,293 A 8/1997 Ellis
5,797,246 A 8/1998 Martin-Cocher
5,819,503 A 10/1998 Lancaster, III
5,965,262 A 10/1999 Whisler
6,065,269 A 5/2000 Malnati
6,102,313 A 8/2000 Salzsauler
6,164,047 A 12/2000 Rossi
6,311,459 B1 11/2001 Rossi
6,393,808 B1 5/2002 Kallner
6,688,076 B1 2/2004 Rivera, Jr.
6,745,544 B2 6/2004 Matsumoto
6,775,956 B1 8/2004 Lacey
6,796,105 B2 9/2004 Rossi
6,883,298 B2 4/2005 Gooding
6,892,515 B2 5/2005 Cere
6,971,220 B1 12/2005 Rampp
7,029,206 B2 4/2006 Stockstill
7,269,935 B2 9/2007 Jafari
7,581,368 B1 * 9/2009 Bison ..... B65B 11/045 53/399
7,621,107 B2 11/2009 Vanderheiden
7,908,831 B1 3/2011 Dugan
8,046,975 B1 11/2011 Bison
8,053,056 B2 11/2011 Heikaus
8,276,349 B2 10/2012 Van Amstel
8,528,615 B2 9/2013 Colson
8,549,819 B1 * 10/2013 Bison ..... B65B 11/585 53/399
8,637,134 B1 * 1/2014 Aronsen ..... B32B 3/08 428/137
8,707,664 B1 * 4/2014 Bison ..... B65B 11/045 53/449
8,984,848 B2 * 3/2015 Bison ..... B65B 11/006 53/589
9,254,931 B2 * 2/2016 Bison ..... B65B 11/006
9,802,722 B1 * 10/2017 Bison ..... B65B 11/585
10,279,945 B2 5/2019 Nelson
10,526,099 B2 * 1/2020 Bison ..... B65B 11/585
10,960,998 B2 * 3/2021 Nicholson ..... B65B 11/025
11,434,029 B1 * 9/2022 Bison ..... B65B 59/003
11,628,959 B1 * 4/2023 Bison ..... B65B 11/006 53/399
2004/0244336 A1 12/2004 Suolahti
2005/0123721 A1 * 6/2005 Heikaus ..... B32B 3/14 428/137
2008/0066431 A1 3/2008 Cousins
2008/0092489 A1 4/2008 Smith
2008/0209859 A1 9/2008 Vanderheiden
2009/0178374 A1 7/2009 Lancaster, III
2009/0277136 A1 11/2009 Van Amstel
2009/0293425 A1 12/2009 Carter
2011/0088359 A1 4/2011 Brocard
2012/0102887 A1 5/2012 Lancaster, III
2013/0104754 A1 5/2013 Van Amstel
2013/0326999 A1 12/2013 Lemieux
2014/0331609 A1 * 11/2014 Bison ..... B65B 11/585 53/219
2015/0197355 A1 * 7/2015 Bison ..... B65B 11/045 53/414
2015/0353220 A1 12/2015 Lancaster, III
2016/0098171 A1 4/2016 Lancaster, III
2017/0101205 A1 4/2017 Schieck
2018/0208339 A1 * 7/2018 Bison ..... B65B 11/045
2018/0257799 A1 9/2018 Ragsdale
2019/0084703 A1 3/2019 Nicholson
2020/0299016 A1 9/2020 Lancaster, III
2020/0377250 A1 12/2020 Lancaster, III

FOREIGN PATENT DOCUMENTS

EP 0178145 A1 4/1986
EP 1332968 A1 8/2003
EP 1803345 A1 7/2007
EP 2589540 A1 5/2013
EP 3070003 A1 9/2016
GB 2241484 A 9/1991
JP H0245309 2/1990
JP H04215903 8/1992
JP H04327108 11/1992
JP H10129609 5/1998
JP 10129609 A 5/1999
JP 2000302102 A 10/2000
JP 2002166905 A 6/2002
JP 2002211502 A 7/2002
JP 2002225806 A 8/2002
JP 2002225807 A 8/2002
WO 9012737 A1 11/1990
WO 2009155713 A2 12/2009

OTHER PUBLICATIONS

JPO machine translation of JP 2002-225806 A, Aug. 14, 2013 15 pages.
USPTO translation of JP 2-45309 A, Aug. 13, 2013 7 pages.

* cited by examiner

PALLET WRAPPING SYSTEM WITH OVERLAPPING BANDS

TECHNICAL FIELD

Aspects of this document relate generally to a pallet wrapping system, and more specifically to a pallet wrapping system with overlapping bands.

BACKGROUND

Goods to be transported in containers on, for example, ships, trucks, trains or the like frequently are packed on pallets. Such palletized goods or material may be wrapped in stretch film to protect the material from damage caused by, for example, shifting on a pallet or being bumped by goods on adjacent pallets.

A commonly acknowledged need in the industry is to develop systems and methods for reducing the amount of stretch film used per pallet, as well as the amount of time required to wrap each pallet, and/or to eliminate ancillary packaging materials such as corner boards and strapping, without sacrificing load containment.

SUMMARY

Aspects of this document relate to a method of wrapping a palletized load comprising forming at least two composite stretch films including a first composite stretch film and a second composite stretch film, wherein forming each of the at least two composite stretch films comprises passing stretch film from a first spool through a first plurality of guides, narrowing a width of the stretch film from the first spool to create a first banded stretch film, wherein the first banded stretch film has a first width and a filament extending along each of a top edge and a bottom edge of the first banded stretch film, passing stretch film from a second spool through a second plurality of guides, narrowing a width of the stretch film from the second spool to create a second banded stretch film, wherein the second banded stretch film has a second width smaller than the first width and a filament extending along each of a top edge and a bottom edge of the second banded stretch film, and overlaying the second banded stretch film on the first banded stretch film to form each of the at least two composite stretch films, wherein each of the filaments of the second banded stretch film is positioned between the filaments of the first banded stretch film, after overlaying, pre-stretching each of the at least two composite stretch films by at least 275%, simultaneously wrapping each of the at least two composite stretch films around the palletized load, and leaving a gap having a width equal to or larger than the first width between the first composite stretch film and the second composite stretch film as the at least two composite stretch films are wrapped around the palletized load.

Particular embodiments may comprise one or more of the following features. Each of the at least two composite stretch films may be pre-stretched by between 275% and 340%. The first width may be between 1.5 inches and 15 inches. Forming each of the at least two composite stretch films further may comprise centering the second banded stretch film on the first banded stretch film.

Aspects of this document relate to a method of wrapping a palletized load comprising forming at least two composite stretch films including a first composite stretch film and a second composite stretch film, wherein forming each of the at least two composite stretch films comprises narrowing a width of stretch film from a first spool to create a first banded stretch film with a first width and a filament extending along each of a top edge and a bottom edge of the first banded stretch film, narrowing a width of stretch film from a second spool to create a second banded stretch film with a second width and a filament extending along each of a top edge and a bottom edge of the second banded stretch film, wherein the second width is smaller than the first width, overlaying the second banded stretch film on the first banded stretch film to form each of the at least two composite stretch films, wherein each of the filaments of the second banded stretch film is positioned between the filaments of the first banded stretch film, wrapping each of the at least two composite stretch films around the palletized load, and leaving a gap having a width equal to or larger than the first width between the first composite stretch film and the second composite stretch film as the at least two composite stretch films are wrapped around the palletized load.

Particular embodiments may comprise one or more of the following features. The method may further comprise pre-stretching the composite stretch film by at least 275%. The method may further comprise pre-stretching the composite stretch film by between 300% and 340%. the first width may be between 1.5 inches and 15 inches. Forming each of the at least two composite stretch films may further comprise centering the second banded stretch film on the first banded stretch film. Wrapping each of the at least two composite stretch films around the palletized load may occur simultaneously. The at least two composite stretch films may further include a third composite stretch film and the method may further comprise leaving a gap having a width equal to or larger than the first width between the second composite stretch film and the third composite stretch film as the at least two composite stretch films are wrapped around the palletized load.

Aspects of this document relate to a method of wrapping a palletized load comprising forming at least two composite stretch films including a first composite stretch film and a second composite stretch film, wherein forming each of the at least two composite stretch films comprises narrowing a width of stretch film from a first spool to create a first banded stretch film with a first width, narrowing a width of stretch film from a second spool to create a second banded stretch film with a second width, wherein the second width is smaller than the first width, and overlaying the second banded stretch film on the first banded stretch film to form each of the at least two composite stretch films, wherein the second banded stretch film is positioned between a top edge and a bottom edge of the first banded stretch film, wrapping each of the at least two composite stretch films around the palletized load, and leaving a gap having a width that is equal to or larger than half of the first width between the first composite stretch film and the second composite stretch film as the at least two composite stretch films are wrapped around the palletized load Particular embodiments may comprise one or more of the following features. The first banded stretch film may have a filament extending along each of the top edge and the bottom edge and the second banded stretch film may have a filament extending along each of a top edge and a bottom edge of the second banded stretch film. Forming the at least two composite stretch films may further comprise passing the stretch film from the first spool through a first plurality of guides and passing the stretch film from the second spool through a second plurality of guides. The method may further comprise pre-stretching the composite stretch film by at least 275%. The method may further comprise pre-stretching the composite stretch film by between 300% and 340%. The first width may be between 1.5 inches and 15 inches. Forming each of the at least two composite stretch films may further comprise centering the second banded stretch film on the first banded stretch film. Wrapping each of the at least two composite stretch films around the palletized load may occur simultaneously. The at least two composite stretch films may further include a third composite stretch film and the method may further comprise leaving a gap having a width equal to or larger than half of the first width between the second composite stretch film and the third composite stretch film as the at least two composite stretch films are wrapped around the palletized load.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
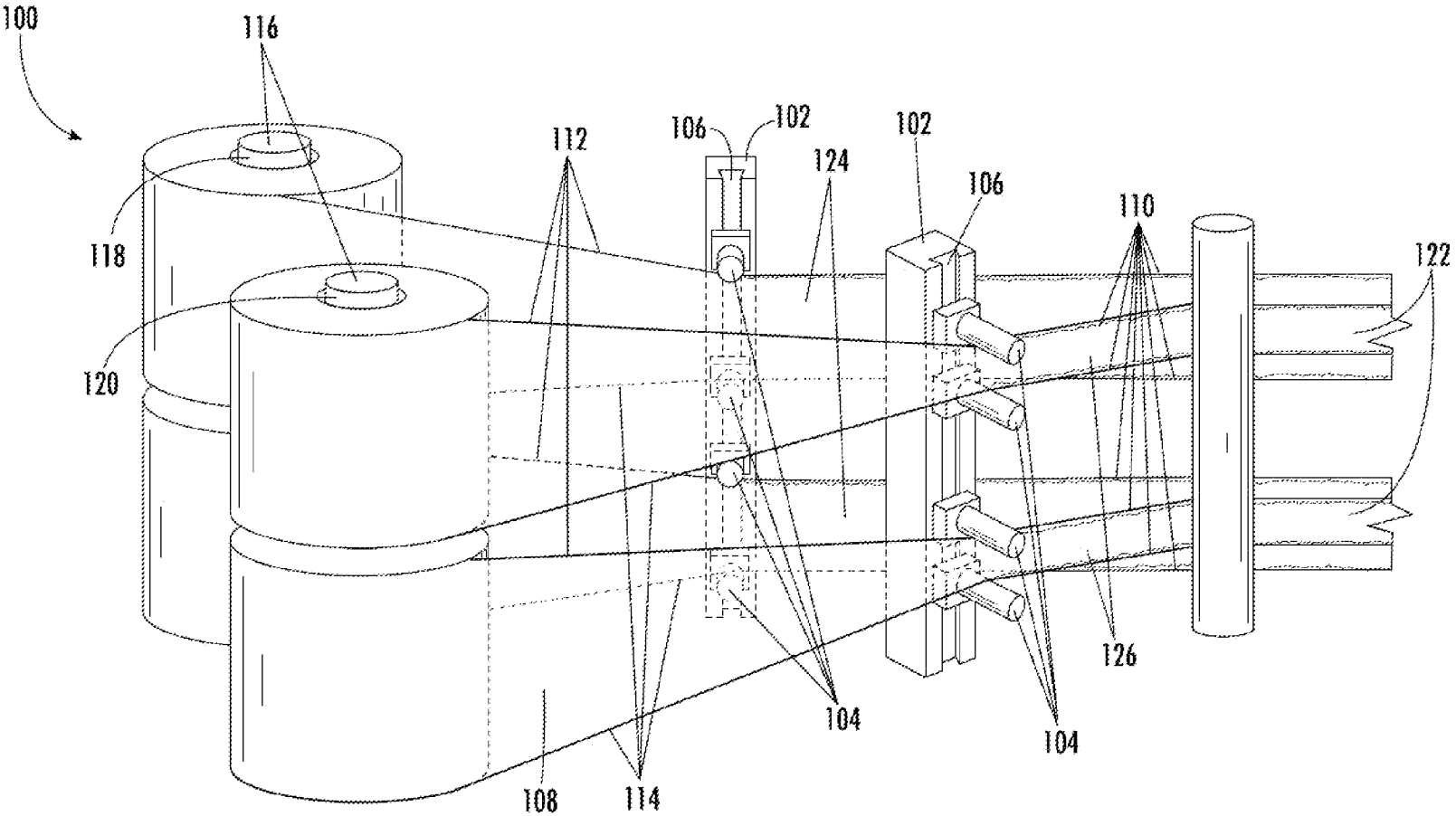
FIG. 1 is a perspective view of a pallet wrapping system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

Figure 2:
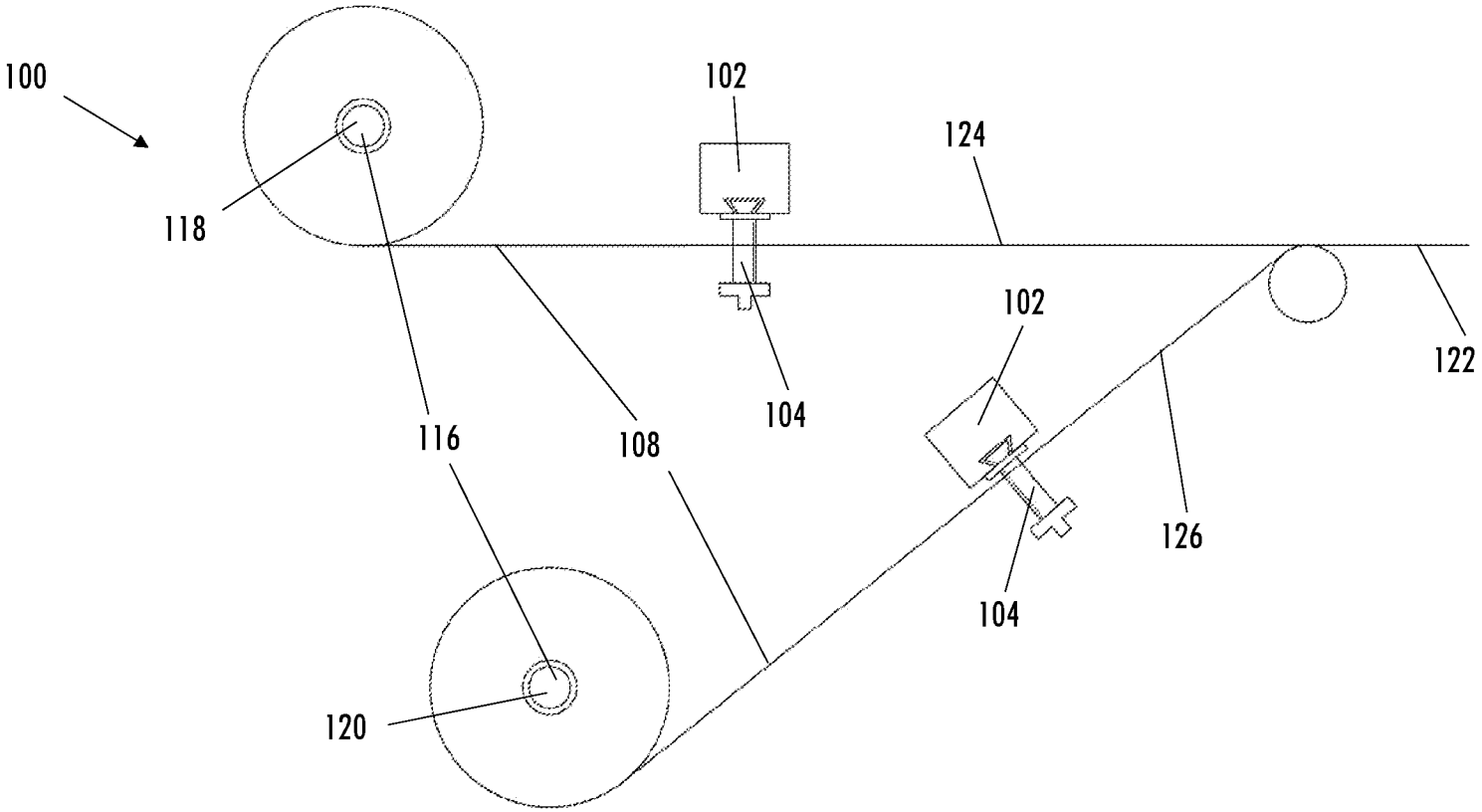
FIG. 2 is a top view of the pallet wrapping system shown in FIG. 1.

The present disclosure is related to a pallet wrapping system 100 that creates a composite stretch film that is designed to reduce the amount of stretch film required to secure a palletized load for shipping and decrease the amount of time required to wrap the palletized load. The pallet wrapping system 100 may comprise a plurality of support bars 102 and a plurality of guides 104, as shown in FIGS. 1-2. The support bar 102 may have a channel 106 that extends parallel to a length of the support bar 102 for a majority of the length of the support bar 102. This allows the plurality of guides 104 to be affixed to the support bar 102 at any desired position along the channel 106. Each of the guides may have any of the features of the adjustment arms disclosed in U.S. patent application Ser. No. 17/222,843, the disclosure of which is hereby incorporated herein by this reference. The plurality of guides 104 are coupled to the support bar 102 and are configured to narrow the width of a stretch film 108 for wrapping a palletized load. As shown in FIGS. 1-2, the plurality of guides 104 may be arranged in pairs, with each pair separated by a distance less than the width of the stretch film 108. Thus, when the stretch film 108 passes through the plurality of guides 104, the guides 104 form a filament 110 on the top edge 112 and the bottom edge 114 of the stretch film 108 to result in a narrower stretch film with banded edges. The filament 110 is an edge of the stretch film 108 that has been banded, rolled, folded, bunched together, etc. The filament 110 provides additional strength to the stretch film 108 because of its resistance towards tearing. Because the plurality of guides 104 can be affixed to the support bar 102 at any desired position along the channel 106, the user can adjust the plurality of guides 104 to adjust the width of the banded stretch film exiting the plurality of guides 104.

The pallet wrapping system 100 may also comprise at least one spool 116 configured to hold and dispense the stretch film 108. The at least one spool 116 may comprise a first spool 118 and a second spool 120, as shown in FIGS. 1-2. Each of the at least one spool 116 may have more than one roll of stretch film 108. The rolls of stretch film 108 on the same spool 116 may be configured to dispense from the spool 116 at the same rate.

Figure 3:
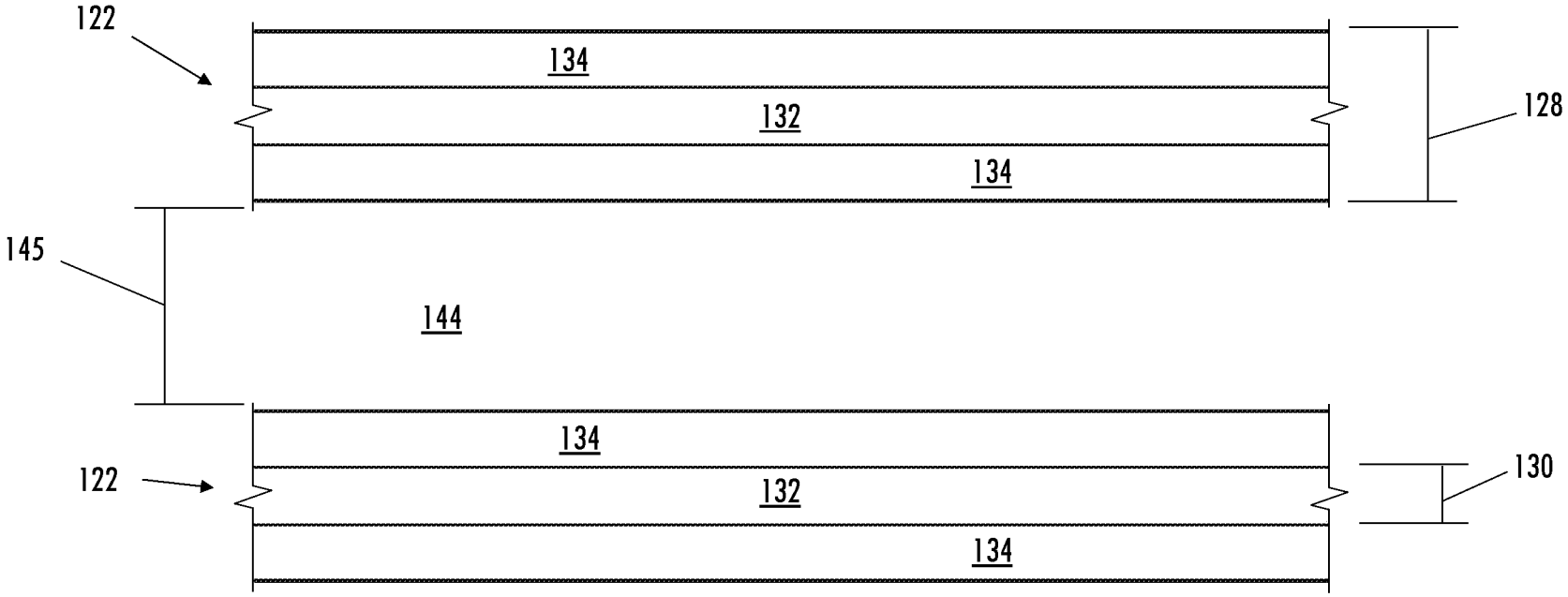
FIG. 3 is a front view of a composite stretch film created by the pallet wrapping system shown in FIG. 1.

The pallet wrapping system 100 may be used to form a composite stretch film 122, as shown in FIG. 1 and FIG. 3, which may be wrapped around a palletized load. The composite stretch film 122 may be formed from two rolls of stretch film 108. For example, stretch film 108 from the first spool 118 may be passed through a first plurality of guides 104, thus narrowing a width of the stretch film 108 from the first spool 118 to create a first banded stretch film 124, and stretch film 108 from the second spool 120 may be passed through a second plurality of guides 104, thus narrowing a width of the stretch film 108 from the second spool 120 to create a second banded stretch film 126. The first banded stretch film 124 has a first width 128 and the second banded stretch film 126 has a second width 130. For example, the first width may be between 1.5 inches and 15 inches. In some embodiments, the first width is between 3.5 inches and 5 inches. The second width 130 may be smaller than the first width 128. The second banded stretch film 126 may be overlayed on the first banded stretch film 124 with each of the filaments 110 of the second banded stretch film 126 positioned between the filaments 110 of the first banded stretch film 124. In other words, once overlayed onto the first banded stretch film 124, the second banded stretch film 126 may be positioned between the top edge 112 and the bottom edge 114 of the first banded stretch film 124, as shown in FIG. 3. Thus, each composite stretch film 122 may have a central region 132 with two layers of stretch film 108 and two side regions 134 with one layer of stretch film 108, with each region separated from adjacent regions by a filament 110.

Figure 4:
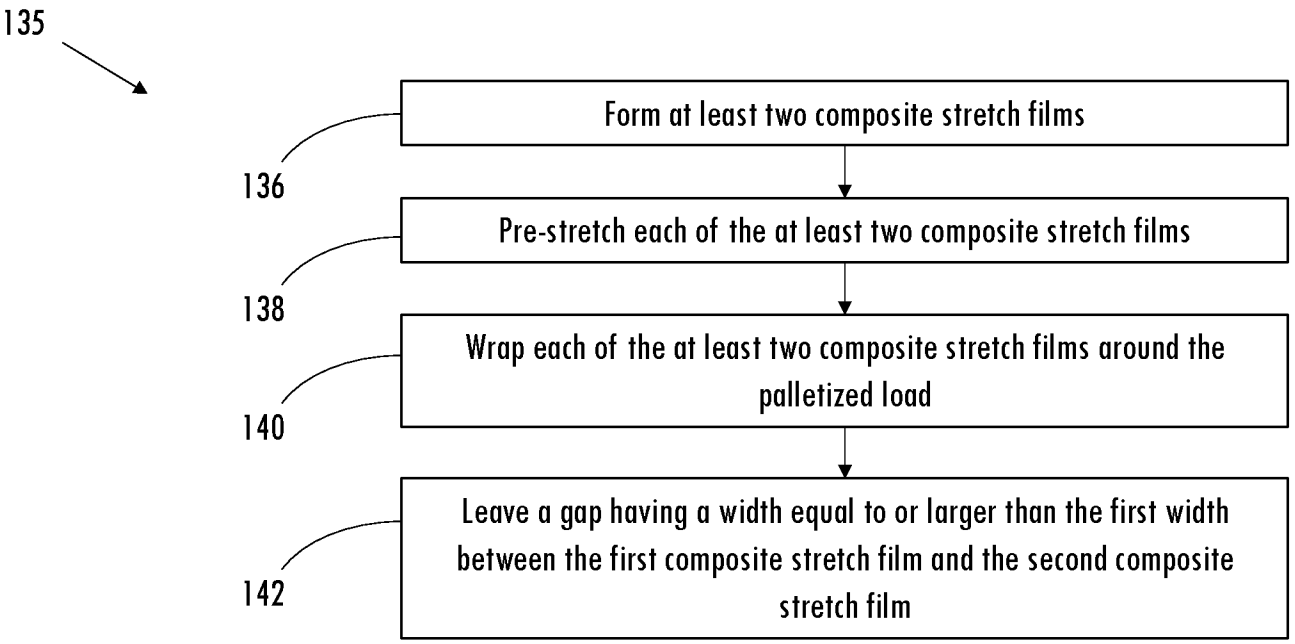
FIG. 4 is a process diagram illustrating the method of wrapping a palletized load using the pallet wrapping system shown in FIG. 1.

As shown in FIG. 4, wrapping a palletized load 135 may comprise forming at least two composite stretch films 136, which may include a first composite stretch film 122, a second composite stretch film 122, and a third composite stretch film 122, pre-stretching each of the at least two composite stretch films 138, wrapping each of the at least two composite stretch films around the palletized load 140, and, as the at least two composite stretch films are wrapped around the palletized load, leaving a gap between the first composite stretch film and the second composite stretch film 142. The gap 144 may have a width 145 equal to or larger than the first width of the first banded stretch film. A similar gap may be left between the second composite stretch film 122 and the third composite stretch film 122 as the at least two composite stretch films are wrapped around the palletized load.

During conventional wrapping of palletized loads, the stretch film 108 often has a stretch limit between 190% and 275%, depending on the stretch film's resin blend and the type of load being wrapped. Pre-stretching by more than 275% often causes the stretch film 108 to tear. For the present disclosure, the composite stretch film 122 may be pre-stretched beyond 275%. In some implementations, the pre-stretch may be at least 300%, at least 340%, or between 300% and 340%. This increased stretch in the composite stretch film 122 is possible because of the additional strength that the filaments 110 provide to the composite stretch film 122. The increased stretch facilitates securing the palletized load with less stretch film 108 because the stretch film 108 that is used maintains a tighter grip.

Wrapping each of the at least two composite stretch films 122 may occur simultaneously. In other words, both the first composite stretch film 122 and the second composite stretch film 122 may be wrapped around the palletized load at the same time. Thus, it is possible to leave the gap 144 between the first composite stretch film 122 and the second composite stretch film 122 by having the first composite stretch film 122 separated from the second composite stretch film 122, as shown in FIGS. 1 and 3. As mentioned above, the gap 144 may have a width 145 equal to or larger than the first width 128. In some implementations, the gap 144 may have a width 145 equal to or larger than half of the first width 128. The gap 144 increases the air circulation with the palletized load. Thus, the gap 144 may be especially helpful when wrapping produce or other items that require good air circulation. In addition, the gap 144 decreases the amount of stretch film 108 required to secure the palletized load because the gap 144 does not need to be filled in with stretch film 108 to secure the palletized load and decreases the amount of time required to wrap the palletized load because at least two composite stretch films 122 are wrapped around the palletized load at once, thus reducing the number of times the palletized load must be rotated.

Figure 5:
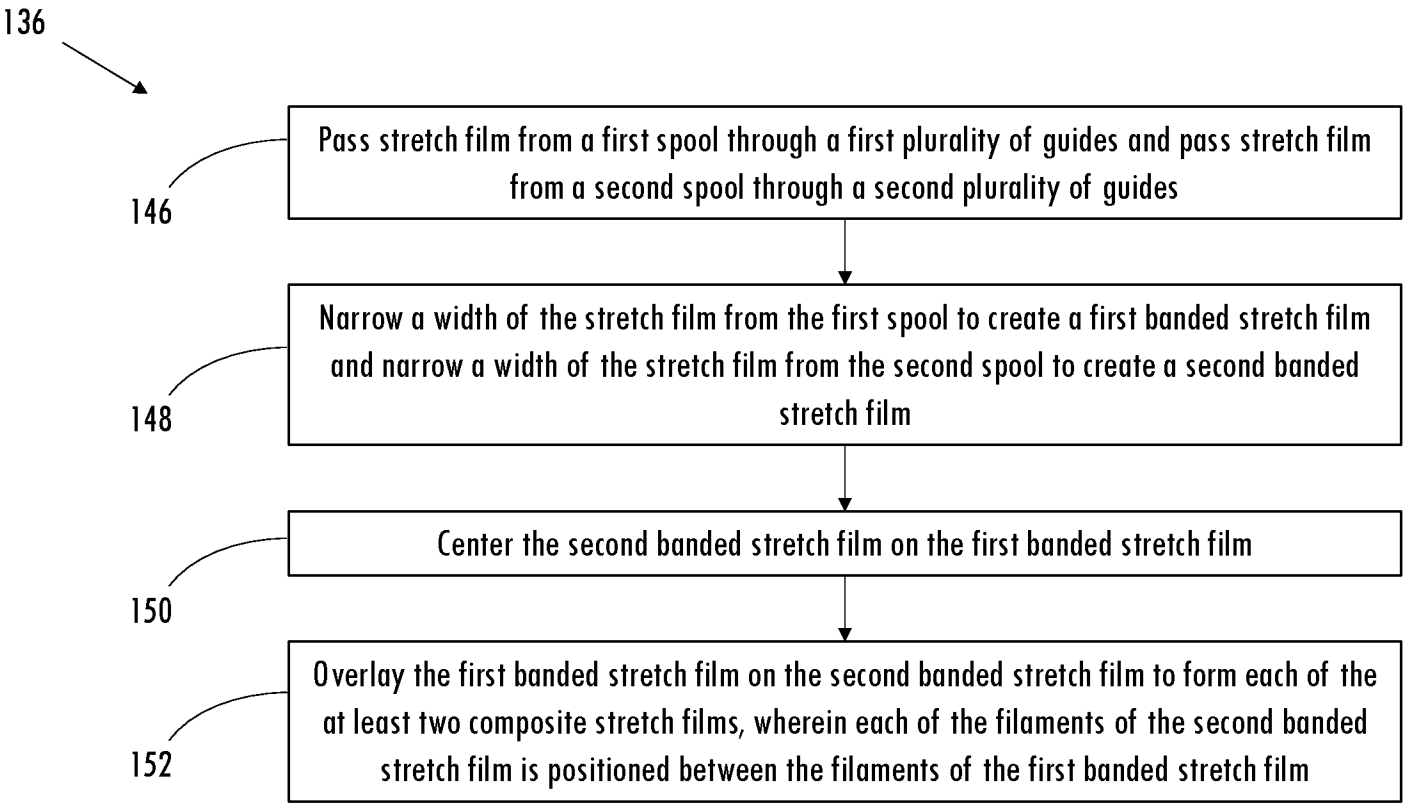
FIG. 5 is a process diagram illustrating the method of forming each of the composite stretch films used to wrap a palletized load using the pallet wrapping system shown in FIG. 1.

As shown in FIG. 5, forming each of the composite stretch films 136 may comprise passing stretch film from the first spool through the first plurality of guides and passing stretch film from the second spool through the second plurality of guides 146, narrowing the width of the stretch film from the first spool to create a first banded stretch film and narrowing the width of the stretch film from the second spool to create a second banded stretch film 148, and overlaying the second banded stretch film on the first banded stretch film to form each of the at least two composite stretch films 152. Forming the at least two composite stretch films may further comprise centering the second banded stretch film on the first banded stretch film 150.

It will be understood that implementations of a pallet wrapping system are not limited to the specific assemblies, devices and components disclosed in this document, as virtually any assemblies, devices and components consistent with the intended operation of a pallet wrapping system may be used. Accordingly, for example, although particular pallet wrapping systems, and other assemblies, devices and components are disclosed, such may include any shape, size, style, type, model, version, class, measurement, concentration, material, weight, quantity, and/or the like consistent with the intended operation of pallet wrapping systems. Implementations are not limited to uses of any specific assemblies, devices and components; provided that the assemblies, devices and components selected are consistent with the intended operation of a pallet wrapping system.

Accordingly, the components defining any pallet wrapping system may be formed of any of many different types of materials or combinations thereof that can readily be formed into shaped objects provided that the materials selected are consistent with the intended operation of a pallet wrapping system. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various pallet wrapping systems may be manufactured using conventional procedures as added to and improved upon through the procedures described here. Some components defining a pallet wrapping system may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing, assembling, or using pallet wrapping systems are not limited to the specific order of steps as disclosed in this document. Any steps or sequence of steps of the assembly of a pallet wrapping system indicated herein are given as examples of possible steps or sequence of steps and not as limitations, since various assembly processes and sequences of steps may be used to assemble pallet wrapping systems.

The implementations of a pallet wrapping system described are by way of example or explanation and not by way of limitation. Rather, any description relating to the foregoing is for the exemplary purposes of this disclosure, and implementations may also be used with similar results for a variety of other applications employing a pallet wrapping system.

What is claimed is:

1. A method of wrapping a palletized load, comprising:

forming at least two composite stretch films including a first composite stretch film and a second composite stretch film, wherein forming each of the at least two composite stretch films comprises:

passing stretch film from a first spool through a first plurality of guides;

narrowing a width of the stretch film from the first spool to create a first banded stretch film, wherein the first banded stretch film has a first width and a filament extending along each of a top edge and a bottom edge of the first banded stretch film;

passing stretch film from a second spool through a second plurality of guides;

narrowing a width of the stretch film from the second spool to create a second banded stretch film, wherein the second banded stretch film has a second width smaller than the first width and a filament extending along each of a top edge and a bottom edge of the second banded stretch film; and overlaying the second banded stretch film on the first banded stretch film to form each of the at least two composite stretch films, wherein each of the filaments of the second banded stretch film is positioned between the filaments of the first banded stretch film;

after overlaying, pre-stretching each of the at least two composite stretch films by at least 275%;

simultaneously wrapping each of the at least two composite stretch films around the palletized load; and leaving a gap having a width equal to or larger than the first width between the first composite stretch film and the second composite stretch film as the at least two composite stretch films are wrapped around the palletized load.

2. The method of claim 1, wherein each of the at least two composite stretch films are pre-stretched by between 275% and 340%.

3. The method of claim 1, wherein the first width is between 1.5 inches and 15 inches.

4. The method of claim 1, wherein forming each of the at least two composite stretch films further comprises centering the second banded stretch film on the first banded stretch film.

5. A method of wrapping a palletized load, comprising:

forming at least two composite stretch films including a first composite stretch film and a second composite stretch film, wherein forming each of the at least two composite stretch films comprises:

narrowing a width of stretch film from a first spool to create a first banded stretch film with a first width and a filament extending along each of a top edge and a bottom edge of the first banded stretch film;

narrowing a width of stretch film from a second spool to create a second banded stretch film with a second width and a filament extending along each of a top edge and a bottom edge of the second banded stretch film, wherein the second width is smaller than the first width; and overlaying the second banded stretch film on the first banded stretch film to form each of the at least two composite stretch films, wherein each of the filaments of the second banded stretch film is positioned between the filaments of the first banded stretch film;

wrapping each of the at least two composite stretch films around the palletized load; and leaving a gap having a width equal to or larger than the first width between the first composite stretch film and the second composite stretch film as the at least two composite stretch films are wrapped around the palletized load.

6. The method of claim 5, further comprising pre-stretching the composite stretch film by at least 275%.

7. The method of claim 5, further comprising pre-stretching the composite stretch film by between 300% and 340%.

8. The method of claim 5, wherein the first width is between 1.5 inches and 15 inches.

9. The method of claim 5, wherein forming each of the at least two composite stretch films further comprises centering the second banded stretch film on the first banded stretch film.

10. The method of claim 5, wherein wrapping each of the at least two composite stretch films around the palletized load occurs simultaneously.

11. The method of claim 5, the at least two composite stretch films further including a third composite stretch film, the method further comprising leaving a gap having a width equal to or larger than the first width between the second composite stretch film and the third composite stretch film as the at least two composite stretch films are wrapped around the palletized load.

12. A method of wrapping a palletized load, comprising:

forming at least two composite stretch films including a first composite stretch film and a second composite stretch film, wherein forming each of the at least two composite stretch films comprises:

narrowing a width of stretch film from a first spool to create a first banded stretch film with a first width;

narrowing a width of stretch film from a second spool to create a second banded stretch film with a second width, wherein the second width is smaller than the first width; and overlaying the second banded stretch film on the first banded stretch film to form each of the at least two composite stretch films, wherein the second banded stretch film is positioned between a top edge and a bottom edge of the first banded stretch film;

wrapping each of the at least two composite stretch films around the palletized load; and leaving a gap having a width that is equal to or larger than half of the first width between the first composite stretch film and the second composite stretch film as the at least two composite stretch films are wrapped around the palletized load.

13. The method of claim 12, wherein the first banded stretch film has a filament extending along each of the top edge and the bottom edge and the second banded stretch film has a filament extending along each of a top edge and a bottom edge of the second banded stretch film.

14. The method of claim 12, wherein forming the at least two composite stretch films further comprises passing the stretch film from the first spool through a first plurality of guides and passing the stretch film from the second spool through a second plurality of guides.

15. The method of claim 12, further comprising pre-stretching the composite stretch film by at least 275%.

16. The method of claim 12, further comprising pre-stretching the composite stretch film by between 300% and 340%.

17. The method of claim 12, wherein the first width is between 1.5 inches and 15 inches.

18. The method of claim 12, wherein forming each of the at least two composite stretch films further comprises centering the second banded stretch film on the first banded stretch film.

19. The method of claim 12, wherein wrapping each of the at least two composite stretch films around the palletized load occurs simultaneously.

20. The method of claim 12, the at least two composite stretch films further including a third composite stretch film, the method further comprising leaving a gap having a width equal to or larger than half of the first width between the second composite stretch film and the third composite stretch film as the at least two composite stretch films are wrapped around the palletized load.

* * * * *